US006543357B2

(12) United States Patent
Schroeder

(10) Patent No.: US 6,543,357 B2
(45) Date of Patent: Apr. 8, 2003

(54) PRINTING GROUP OF A ROTARY ROLLER PRINTING MACHINE, PREFERABLY A ROTOGRAVURE ROTARY ROLLER PRINTING MACHINE

(75) Inventor: Volker Schroeder, Ladbergen (DE)

(73) Assignee: Windmöller & Hölscher, Lengerich (DE)

( * ) Notice: Subject to any disclaimer, the term of this patent is extended or adjusted under 35 U.S.C. 154(b) by 9 days.

(21) Appl. No.: 09/840,081

(22) Filed: Apr. 24, 2001

(65) Prior Publication Data

US 2001/0037739 A1 Nov. 8, 2001

(30) Foreign Application Priority Data

May 3, 2000 (DE) ..... 100 21 398

(51) Int. Cl.[7] ..... B41F 1/40; B41F 31/00
(52) U.S. Cl. ..... 101/349.1; 101/206
(58) Field of Search ..... 101/349.1, 350.1, 101/353, 359, 152, 176, 180, 181, 221, 153, 91–93, 206

(56) References Cited

U.S. PATENT DOCUMENTS 3,610,144 A * 10/1971 Woessner et al. ..... 101/153
5,497,700 A * 3/1996 Herb ..... 101/153

FOREIGN PATENT DOCUMENTS

| | | |
|---|---|---|
| DE | 123 910 | 1/1977 |
| DE | 35 17 634 | 11/1985 |
| WO | 98/50235 | 11/1998 |

* cited by examiner

*Primary Examiner*—Raquel Yvette Gordon
*Assistant Examiner*—An H. Do
(74) *Attorney, Agent, or Firm*—Jacobson Holman PLLC

(57) ABSTRACT

An apparatus for supporting the shaft journals of a printing cylinder, that can be dipped into a dye vat, of a rotary roller printing machine, preferably a Rotogravure Rotary Roller Printing Machine, on support rolls for the purpose of exchanging the printing cylinder. In order to be able to exchange the printing cylinder in a simple and fast manner, the support rolls are arranged on horizontally movable beams via which the support rolls can be shifted between the bearings of the printing cylinder and an extended position in which there is provided a device that lifts and inserts the printing cylinder.

15 Claims, 5 Drawing Sheets

PRINTING GROUP OF A ROTARY ROLLER PRINTING MACHINE, PREFERABLY A ROTOGRAVURE ROTARY ROLLER PRINTING MACHINE

BACKGROUND OF THE INVENTION

1. Field of the Invention

This invention relates to a printing group of a rotary roller printing machine, preferably a Rotogravure Rotary Roller Printing Machine, with a printing cylinder that is dipped into a dye vat and whose shaft journals can be supported on support devices, preferably supporting rolls, for the purpose of exchanging the printing cylinder.

2. Description of the Related Art

After the printing order has been finished, the printing cylinder of a printing group or the printing cylinders of the printing groups of a Rotogravure Rotary Roller Printing Machine must be taken out and must be replaced for the next printing order by correspondingly altered printing cylinders. Here, an effort is made to perform the required refitting work in the shortest possible time in order to reduce the unproductive idle times of the printing machine. To change a printing cylinder, the latter—after separation of the bearings holding its shaft journals—is usually supported on supporting rolls over segments of its shaft journal, from which the printing cylinder is then removed, for example, via hoisting and transport devices, and upon which an exchanged printing cylinder is then placed. EP 0 980 312 A1 discloses a printing group of the kind mentioned initially where, for the purpose of changing the printing cylinder, one must place one of the support rolls that support shaft journals, in a second position.

SUMMARY OF THE INVENTION

The object of the invention is to create a printing group of the kind mentioned initially where the printing cylinder can be exchanged in a simple and quick manner.

This problem is solved according to the invention in the following manner. Each support device is arranged on a horizontally movable beam that is provided with a drive, via which one can shift the support devices between the bearings of the printing cylinder and an extended position in which there is provided a device that lifts out and inserts the printing cylinder.

In the printing group according to the present invention, the printing cylinder can be exchanged quickly and in a simple fashion by virtue of the following procedure. The printing cylinder that is to be exchanged and that rests on the support devices, can be run out by the horizontally movable beam so far out of the printing group that it can be deposited in a very easily accessible manner and for the purpose of its exchange, upon a lifting device that, in a corresponding fashion, can also be used for the insertion of the printing cylinder that is to be exchanged.

In a practical manner, the horizontally movable beams are racks that can be moved in guides. In the process, the racks can be driven by a shaft that bears the pinion gears which drive the racks.

The device that lifts and inserts the printing cylinders can consist of synchronized lifting and lowering bearings for the shaft journals. The latter can lift the printing cylinder off its support device and hold it, in which connection the printing cylinder can be lifted off the bearings by the usual hoisting and transport devices, for example, forklifts.

The guides and the drive for support bearings are in a practical manner arranged in a frame that is connected with the frame of the printing group.

The following is provided according to a particularly preferred embodiment. Two pairs of support bearings are arranged offset in term of height in each of two beams that can be lifted and lowered in the guides. This design of the invention makes it possible to house the printing cylinder to be exchanged in one pair of the support bearings and, in the other pair of the support bearings, to keep in readiness the printing cylinder that is to be newly installed, so that the exchange can be done briskly and so that the exchanged printing cylinder can be taken out, while the other one is moved into its operating position or has thus been moved.

If the printing cylinder only, and not also the pertinent dye vat, is to be exchanged, then the dye vat is lowered so that the printing cylinder can be run out horizontally without being obstructed by the dye vat. Another feature of the invention provides the following, for this purpose. The dye vat is retained on a vat carrier that can be lifted and lowered in the printing machine frame. The drive of the vat carrier can consist of a pinion gear and rack drive. In a practical manner, the vat carrier is retained in a horizontally movable fashion in a guide device that can be lifted and lowered in the printing machine frame so that, via such carrier, the dye vat can also be run out of the printing group for the purpose of exchanging it.

It is frequently required to exchange the printing cylinder and at the same time also its dye vat so as to coordinate their formats with each other. To meet this requirement, another feature of the invention provides for the following. In its raised position, the dye vat can be coupled to the horizonally movable beam so that it can be run out and run in together with the printing cylinder.

In a practical manner, the beam is equipped with a clutch rod that is provided with a groove or borehole which, in the raised position of the vat carrier, engages a pin or peg that is connected with the vat carrier.

According to a preferred embodiment, the following is provided so that the dye vat and the pertinent printing cylinder can also be exchanged in a simple manner and quickly. The beams, that can be lifted and lowered, are provided, under the support bearing or the support bearings for the printing cylinders, with a support bearing or support bearings for the dye vat or the dye vats.

BRIEF DESCRIPTION OF THE DRAWINGS

An exemplary embodiment of the invention will be described in greater detail below with reference to the drawings.

DETAILED DESCRIPTION OF THE PREFERRED EMBODIMENTS

Figure 1:
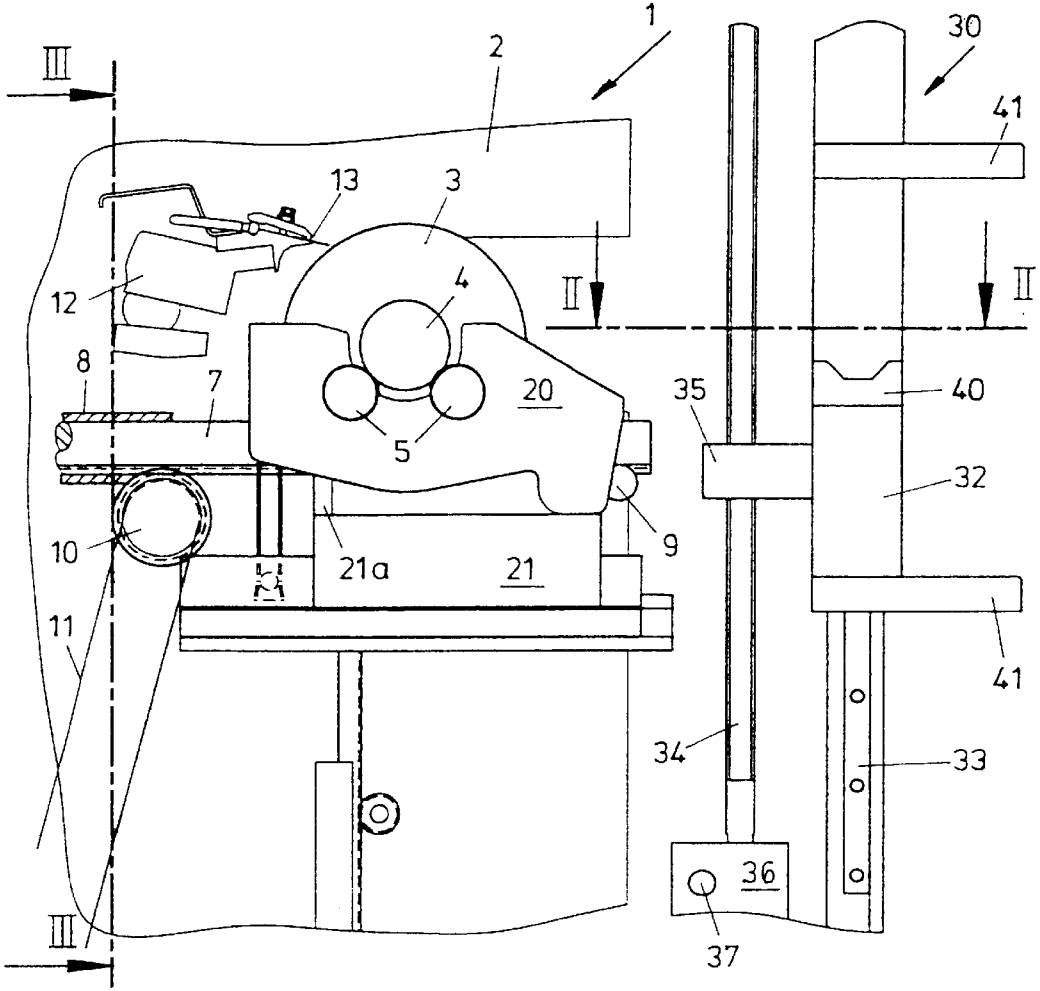
FIG. 1 is a side view of a printing group with removed front side frame where the printing cylinder, to be exchanged, rests on supporting rolls, and with a device that lifts and inserts the printing cylinder, in accordance with the present invention.
Figure 2:
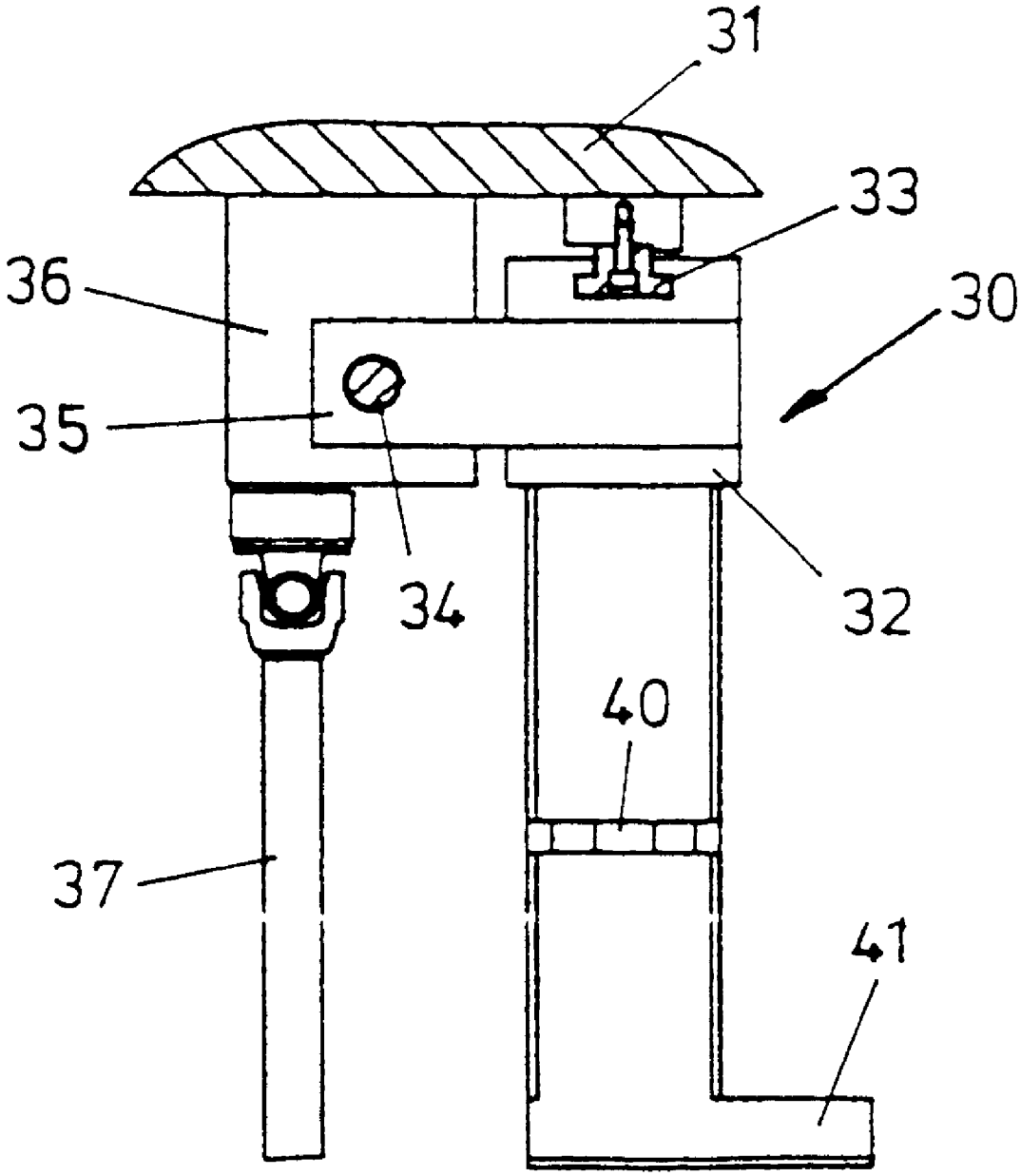
FIG. 2 is a top view of the device that lifts and inserts the printing cylinders, taken along II—II of FIG. 1.
Figure 3:
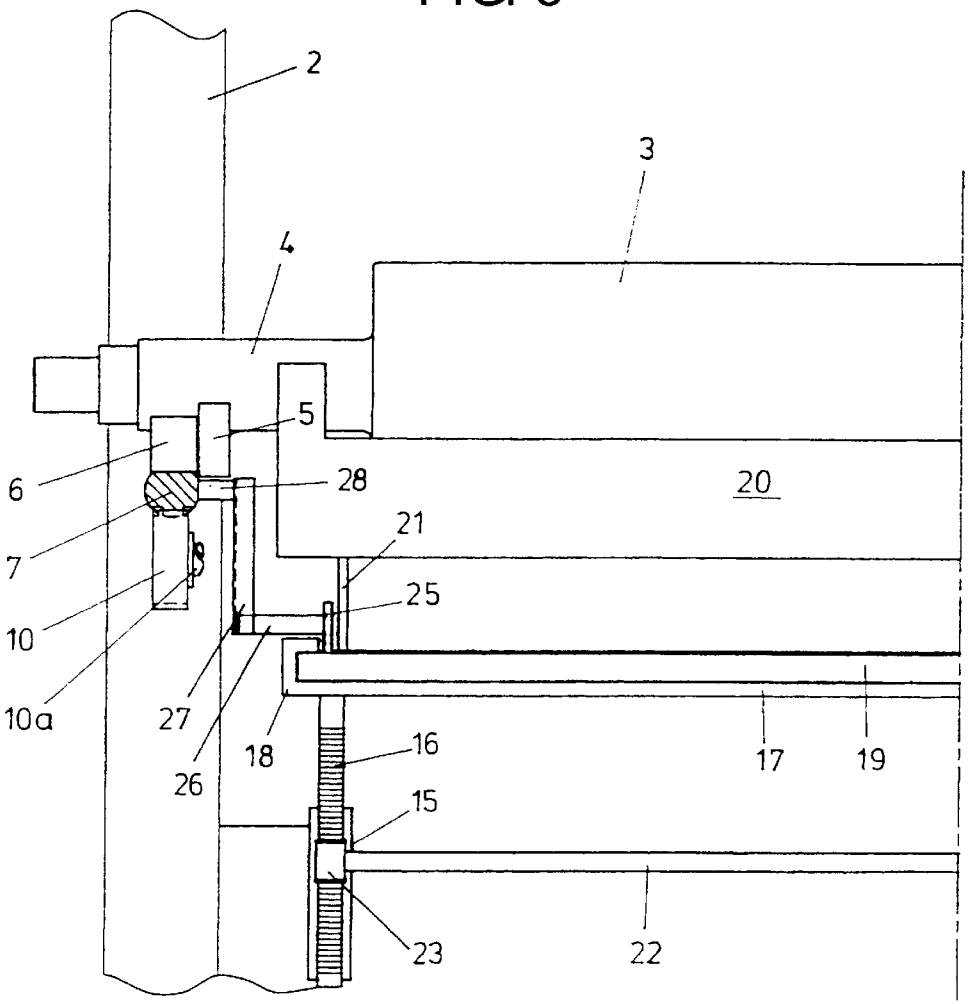
FIG. 3 is a view of the printing group taken along III—III of FIG. 1.

The printing group 1 according to the present invention has a printing group frame of which only the rear side frame 2 is visible because the front one has been removed for the sake of greater clarity. In the illustrated printing group of a Rotogravure Rotary Roller Printing Machine, printing cylinder 3 is positioned via its shaft journal 4, in the usual manner, in the side frames 2 of the printing group frame. In the position shown in FIGS. 1 and 3, printing cylinder 3 is taken out of its bearings and is supported on support rolls 5 to prepare for its exchange. Support rolls 5 are rotatably positioned via shaft journals (not shown) in support roll bearing blocks 6, that are attached on both sides of printing cylinder 3 on racks 7. Racks 7 are guided in their rear area in guides or guide sleeves 8 that are firmly attached to the frame and, in their front area, they are supported on support rolls 9 that are positioned in the frame. To drive the racks 7, that are provided on both sides of printing cylinder 3, there is provided a pinion gear 10 that is positioned in the machine frame and that, in the manner shown, engages rack 7 and, for example, via a toothed belt 11 is driven by a drive, not shown. Drive pinion gears 10 are positioned in a shaft 10*a* that is firmly attached to the frame so that they will drive the two racks 7 in a synchronous manner.

Between side frames 2 of the printing group frame, there is positioned a customary pinion gear carrier 12 that supports the pinion gear knife 13 which can be placed against printing cylinder 3 in the usual fashion.

In the lateral guides 15 of the printing group frame, racks 16 are guided in a vertically movable fashion and, at their upper ends, they have a frame 17 with lateral guides 18 for a vat carrier 19 that can be moved horizontally in guides 18. Dye vat 20 rests on vat carrier 19; the dye vat is supported on the vat carrier 19 by sheet metal pieces forming lateral vat feet and is retained on the vat carrier in a manner not shown.

Racks 16 are provided with a drive (not shown) and a synchronized shaft 22 which, at its ends, carries synchronizing pinion gears 23 that engage racks 16. The synchronized shaft is positioned on the printing group frame in a manner not illustrated.

The vat carrier 19, which can be extended and retracted like a drawer, is connected in its side areas, parallel to vat feet 21, with web plates 25 that carry the pins 26 that protrude at a right angle. In the raised position shown in FIGS. 1 and 3, pins 26 engage the grooves of U-shaped section pieces 27 that are connected via connecting pins 28 with the internal sides of racks 7 so that, together with racks 7, the carrier 19 and dye vat 20 carried thereon, are also moved.

Behind the printing group frame with side parts 2, printing cylinder 3 is possibly arranged with device 30 that lifts and inserts dye vat 20, the side parts 31 of said device being connected rigidly with the side frames 2 of the printing group frame, in a manner not shown. Device 30 consists of two supports 32, that are guided in vertically movable direction via guides 33 in side parts 31. To move support 32, there are provided two spindles 34, positioned on side parts 31, that engage spindle grooves 35 which are connected with supports 32. To drive spindle 34, there are provided gears equipped with drives; gears 36 are connected to each other in the usual manner by means of a synchronized shaft 37.

Each support 32 is provided, at a vertical interval from each other, with two support bearings 40 for the shaft journals 4 of printing cylinders 3 and, below them, with support bearings 41 for the purpose of putting down the vat feet 21.

Dye vat 20 itself is connected in the usual manner with vat feet 21; the rear area of the dye vat is supported on vat feet 21 via an intermediate sheet metal piece 21*a*.

Figure 4:
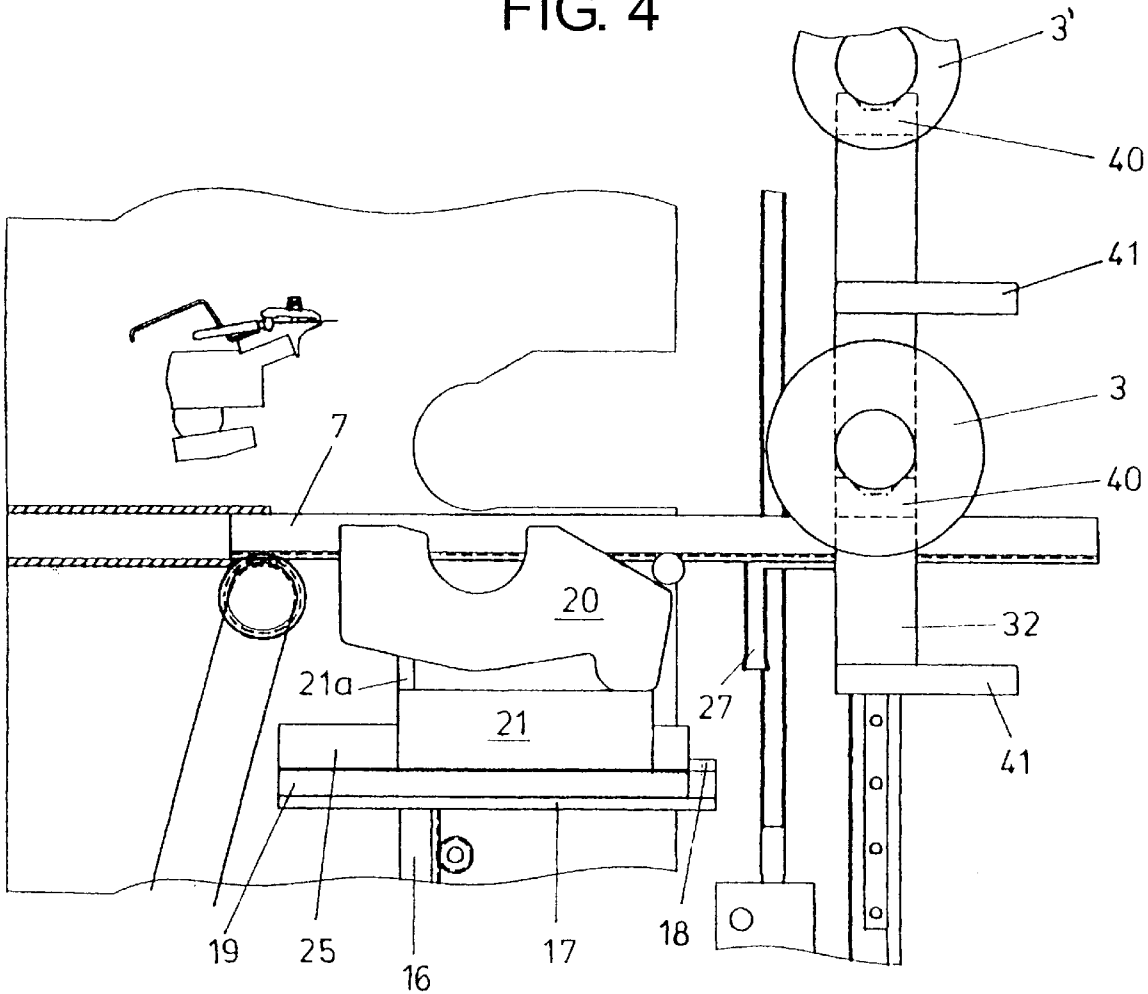
FIG. 4 is an illustration corresponding to FIG. 1, in which the dye vat is lowered and the printing cylinder, to be exchanged, rests on the synchronized, liftable and lowerable support bearings of the device that lifts and inserts the printing cylinder.

FIG. 4 illustrates the situation in which dye vat 20, which is supported and retained on vat carrier 19, is so far lowered via rack 16 that printing cylinder 3 can be pushed off dye vat 20 unhindered, via racks 7 and support rolls 5, to move into the area of device 30 that lifts printing cylinder 3, in that the printing cylinder is lifted off the support rolls 5 by support bearings 40 so that racks 7 can be run back with support rolls 5. In device 30, which lifts and inserts the printing cylinders, there is held in readiness already, in the higher support bearings 40, the printing cylinder 3' that is to be exchanged for printing cylinder 3, which new printing cylinder 3', after the lowering of supports 32 and the renewed extension of support rolls 5, can be placed upon them by means of rack 7. It is thus possible, unhindered, to move the printing cylinder 3' from the exchanged printing cylinder into its operating position and to remove the exchanged printing cylinder 3 during the start of operation or the resumed printing operation.

Figure 5:
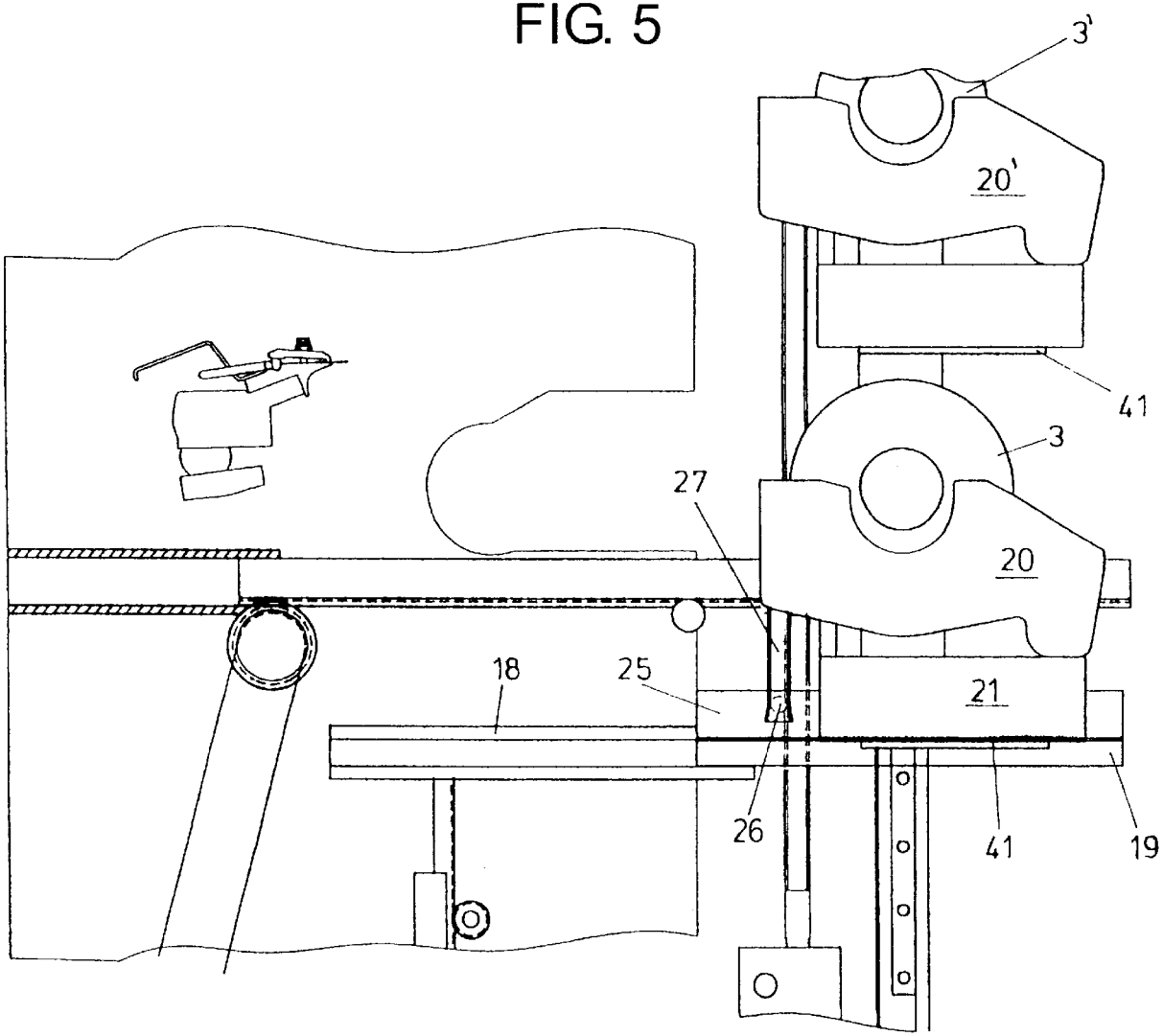
FIG. 5 is an illustration corresponding to FIG. 1, in which the printing cylinder, to be exchanged, along with the pertinent dye vat, is received by the device that lifts and inserts the printing cylinders.

In the position shown in FIG. 5, vat carrier 19 is so lifted with the dye vat 20, supported on the carrier via vat feet 21, that pins 26 of web plates 25 will engage the grooves of the U-shaped section pieces 27 so that, by running out racks 7, printing cylinder 3, together with the dye vat, can be pushed out of the printing machine frame into device 30 in which thereupon printing cylinder 3 is deposited via its shaft journals upon support bearings 40 and in which the vat feet are deposited on support bearings 41.

Above printing cylinder 3, which is to be exchanged, and dye vat 20, the printing cylinder 3' which is to be newly inserted, is held in readiness with pertinent dye vat 20'.

What is claimed is:

1. A printing group of a rotary roller printing machine having a printing group frame, comprising:

a printing cylinder having a shaft journal;

a support roll arranged on a generally horizontally moveable beam for supporting said shaft journal during an exchange of said printing cylinder, said beam guided on said printing group frame and having a drive mechanism by which said printing cylinder can be moved from a printing position to an extended position; and a device which lifts said printing cylinder from said beam when in said extended position and inserts a replacement printing cylinder for return thereof to said printing position through generally horizontal movement of said beam.

2. The printing group as set forth in claim 1, wherein said beam is a rack driven by a shaft that bears a pinion gear.

3. The printing group as set forth in claim 1, wherein said device that lifts said printing cylinder includes support bearings for the shaft journal of said printing cylinder that can be lifted and lowered in a synchronized manner.

4. The printing group as set forth in claim 3, wherein said support bearings move in guides on a frame connected to said printing group frame.

5. The printing group as set forth in claim 4, wherein said support bearings are arranged in pairs offset from one another in height.

6. The printing group as set forth in claim 1, further comprising a vat carrier that can be lifted and lowered in the printing group frame, said vat carrier supporting a dye vat into which said printing cylinder is dipped.

7. The printing group as set forth in claim 6, wherein said vat carrier, in its raised position, can be coupled to the horizontally moveable beam and moved with said printing cylinder from said printing position to said extended position, and vice versa.

8. The printing group as set forth in claim 7, wherein said device that lifts said printing cylinder includes a first support bearing for the shaft journal of said printing cylinder and a second support bearing positioned under said first support bearing for said dye vat, said first and second support bearings moving in a guide so as to be lifted and lowered in a synchronized manner.

9. The printing group as set forth in claim 1, further comprising a vat carrier that is retained in a horizontally movable manner in a guide device that moves substantially parallel with said beam, said vat carrier supporting a dye vat into which said printing cylinder is dipped.

10. The printing group as set forth in claim 9, wherein said beam is provided with a clutch rod having a groove or borehole which engages a pin or peg connected to said vat carrier to move said vat carrier with said printing cylinder from said printing position to said extended position, and vice versa.

11. The printing group as set forth in claim 10, wherein said guide device can be lifted and lowered in said frame, said vat carrier engaging with said clutch rod when in its raised position.

12. The printing group as set forth in claim 10, wherein said device that lifts said printing cylinder includes a first support bearing for the shaft journal of said printing cylinder and a second support bearing positioned under said first support bearing for said dye vat, said first and second support bearings moving in a guide so as to be lifted and lowered in a synchronized manner to exchange said printing cylinder and said dye vat.

13. A printing group of a rotary roller printing machine having a printing group frame, comprising:

a dye vat retained on a vat carrier that can be lifted and lowered in the printing group frame;

a printing cylinder dipped into said dye vat and having a shaft journal;

a generally horizontally moveable beam for supporting said shaft journal during an exchange of said printing cylinder, said beam guided on said printing group frame and engaged with said vat carrier only when said carrier is in its raised position;

a drive mechanism coupled to said beam by which said printing cylinder can be moved from a printing position to an extended position, said vat carrier moving generally horizontally with said beam when engaged therewith in said raised position; and a device which lifts at least said printing cylinder from said beam when in said extended position and inserts a replacement printing cylinder for return thereof to said printing position through generally horizontal movement of said beam.

14. The printing group as set forth in claim 13, wherein said device that lifts said printing cylinder includes a first support bearing for the shaft journal of said printing cylinder and a second support bearing positioned under said first support bearing for said dye vat when said vat carrier is engaged with said beam, said first and second support bearings moving in a guide so as to be lifted and lowered in a synchronized manner.

15. The printing group as set forth in claim 13, wherein said beam is provided with a clutch rod having a groove or borehole which engages a pin or peg connected to said vat carrier when in said raised position to move said vat carrier with said printing cylinder from said printing position to said extended position, and vice versa.

* * * * *